United States Patent [19]

Schmidt et al.

[11] 4,322,876

[45] Apr. 6, 1982

[54] DEVICE FOR INSERTING A SHADOW MASK INTO THE FACEPLATE OF A COLOR-PICTURE TUBE

[75] Inventors: Peter Schmidt, Denkendorf; Emil Mühlberger, Esslingen, both of Fed. Rep. of Germany

[73] Assignee: International Standard Electric Corporation, New York, N.Y.

[21] Appl. No.: 207,171

[22] Filed: Nov. 17, 1980

Related U.S. Application Data

[63] Continuation of Ser. No. 63,013, Aug. 2, 1979, abandoned.

[30] Foreign Application Priority Data

Aug. 26, 1978 [DE] Fed. Rep. of Germany ..... 2837381

[51] Int. Cl.[3] ..... H01J 9/18

[52] U.S. Cl. ..... 29/25.19; 29/25.15

[58] Field of Search ..... 29/25.13, 25.15, 25.19

[56] References Cited

U.S. PATENT DOCUMENTS

| | | | |
|---|---|---|---|
| 3,838,483 | 10/1974 | Baranski | 29/25.15 |
| 4,019,231 | 4/1977 | Dougherty | 29/25.15 |
| 4,130,919 | 12/1978 | Oyama | 29/25.19 |
| 4,164,060 | 8/1979 | Hartta | 29/25.19 |
| 4,188,695 | 2/1980 | Oyama | 29/25.19 |

FOREIGN PATENT DOCUMENTS 2719268 2/1978 France .

*Primary Examiner*—John McQuade

*Attorney, Agent, or Firm*—John T. O'Halloran; Alfred C. Hill

[57] ABSTRACT

To optimize the manufacture of color-picture tubes, automation of the repeated insertion of the shadow mask into the faceplate is desired, but difficulties are encountered because of the undefined positions of the connection members (faceplate studs and shadow mask leaf springs). To solve the problem, a device is disclosed which acts on the connecting members and brings them to a defined position relative to the device to permit automatic engagement of the connecting members.

11 Claims, 4 Drawing Figures

DEVICE FOR INSERTING A SHADOW MASK INTO THE FACEPLATE OF A COLOR-PICTURE TUBE

CROSS REFERENCE TO RELATED APPLICATION

This is a continuation of application Ser. No. 063,013, filed Aug. 2, 1979, now abandoned.

BACKGROUND OF THE INVENTION

The present invention relates to a device for inserting a shadow mask into the faceplate of a color-picture tube.

During the manufacture of a shadow-mask color-picture tube, it is usually necessary to remove and reinsert the shadow mask several times in order to deposit the various phosphors on the screen. To optimize the manufacture of such tubes, it would be desirable if these operations were performed automatically rather than manually.

German Patent DE-OS No. 2,719,268 discloses a method and a device which permit a faceplate to be positioned horizontally and vertically relative to its studs for holding the shadow mask in place, and to insert a shadow mask into the faceplate from a given position such that the exact position of the leaf springs for connecting the mask with the faceplate is known.

In high-quality color-picture tubes, however, the leaf springs at the shadow mask are usually individually adapted to the studs of the faceplate, so that their exact positions vary. Therefore, the method and device disclosed in the above cited German Patent cannot be used to insert such a shadow mask into the associated faceplate.

SUMMARY OF THE INVENTION

An object of the present invention is to provide a device which permit a shadow mask to be inserted into a faceplate even if the outer contour is neither a reference for the exact position of the leaf springs at the shadow mask nor a reference for the exact position of the studs at the faceplate, and if the exact positions of the leaf springs and the studs are not otherwise known before the method is carried out.

Also disclosed is a method of inserting a shadow mask into a faceplate of a color picture tube comprising the steps of positioning the faceplate using studs on the inner side surfaces thereof as reference points, positioning the shadow mask having leaf springs on the external side surfaces thereof each of the leaf springs having a hole for receiving an associated one of the studs and a positioning notch to enable the leaf springs to be employed as reference members, holding the shadow mask in the position found by the reference member, and introducing the shadow mask held in position into the faceplate such that the holes be opposite to and are ready to receive an associated one of the studs.

Another feature of the present invention is the provision of a device for inserting a shadow mask into a faceplate of a color picture tube comprising a first horizontal table having a central cut out therein to support the faceplate having studs on the inner side surfaces thereof and employing the studs as reference points and a second horizontal table disposed in the cut out to support the shadow mask having a frame and leaf springs on the external surfaces thereof, each of the leaf springs having a hole for receiving an associated one of the studs and a positioning notch to enable the second table to employ the leaf springs as reference members, one of the first and second tables being fixed and the other of the first and second tables being vertically movable such that when the faceplate is in position on the first table the second table is under the faceplate.

One advantage of the device according to the present invention is that a faceplate and a shadow mask can be separated automatically if the device is suitably controlled.

BRIEF DESCRIPTION OF THE DRAWING

Above-mentioned and other features and objects of this invention will become more apparent by reference to the following description taken in conjunction with the accompanying drawing, in which.

DESCRIPTION OF THE PREFERRED EMBODIMENTS

In describing the device of the present invention it will be assumed that the faceplate/shadow-mask arrangement has four connecting members—studs 30 at the faceplate and leaf springs 22 having holes 23 for studs 30 at the shadow-mask. The invention can, also, of course, be applied analogously to arrangement with, e.g., three connecting members or connecting members of different design.

Figure 1:
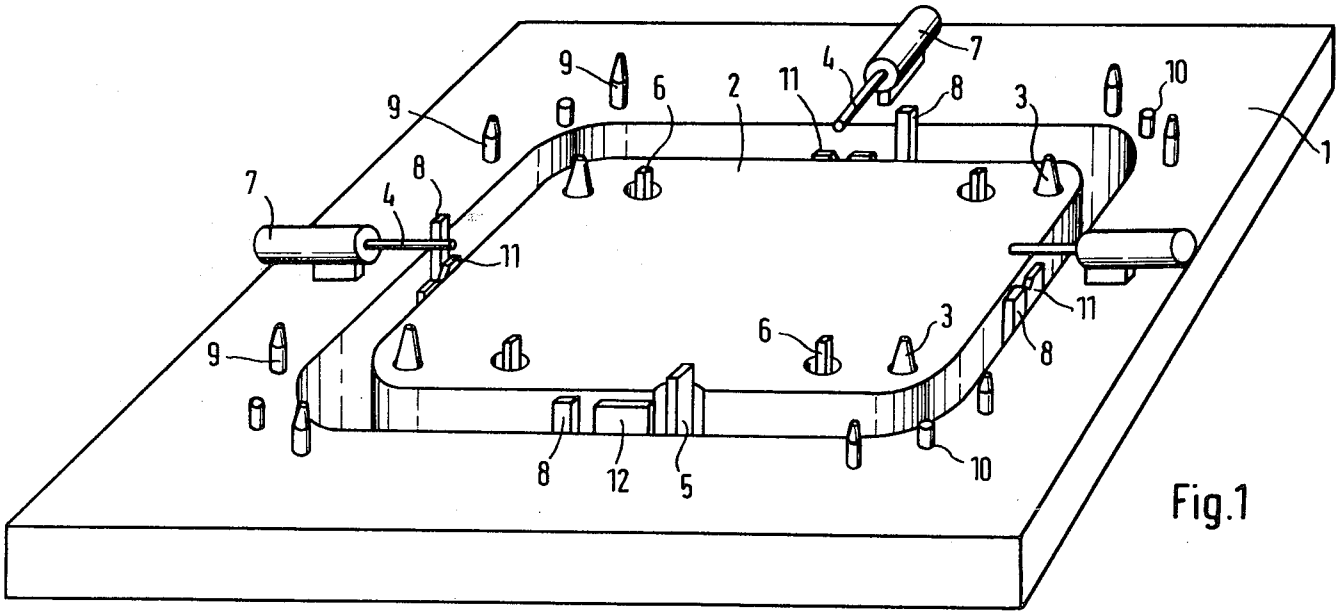
FIG. 1 shows the essential parts of one embodiment of the device in accordance with the principles of the present invention.
Figure 3:
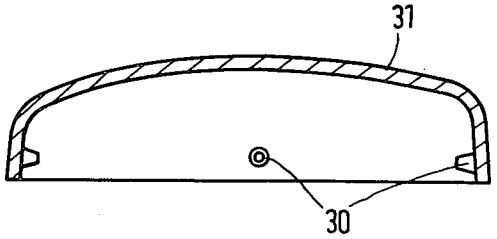
FIG. 3 is a sectional view of a faceplate with studs employed in the embodiment of FIG. 1.

FIG. 1 shows the essential parts of a device according to the present invention for inserting a shadow mask into the faceplate of a color-picture tube. The outer table—the faceplate table 1—serves essentially to support the faceplate and is shown here fixed. The inner table—the mask table 2—serves essentially to support the shadow mask and can be raised and lowered vertically. It is also possible, of course, to fix mask table 2 and make faceplate table 1 vertically movable.

The individual parts of the device and their operation will now be described in the sequence of operations.

Figure 2:
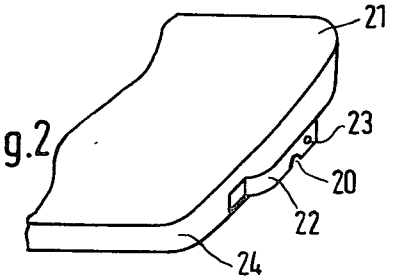
FIG. 2 shows a shadow mask employed in the embodiment of FIG. 1.

At the beginning of the procedure, the two tables 1 and 2 are at rest and approximately level with one another. A shadow mask 21 which, as shown in FIG. 2, is supported by a frame 24, is placed, either manually or by means of a conveyor (not shown), in about the middle of mask table 2, curved side up.

To ensure that shadow mask 21 moves toward the required position on mask table 2 with sufficient accuracy, it is guided by guide members 3 shaped like truncated cones which slide along the rounded corners on the inside of shadow-mask frame 24 and, thus, preposition shadow mask 21.

Horizontal and vertical fine-positioning is effected with centering members 4 acting on the leaf springs 22. These centering members 4 are horizontal, thin pins pointing towards the circumference of shadow mask 21, and since these pins engage notches 20 in leaf springs 22, shadow mask 21 slips into a defined position. Through the fixed geometric relationship between notch 20 and holes 23 in each of the leaf springs 22 and with three of the leaf springs 22 supported by members 4, a fixed relationship is achieved between holes 23 of the three seated leaf springs 22 and the device.

In the shadow masks having four leaf springs 22 are supported by members 4 at only three of the four leaf springs as described above, the center of gravity of the shadow masks may be at the edge of or outside the triangle formed by the points of support at the three leaf springs, thus causing; mask 21 to tilt in the device. To counteract this, a spring-loaded support 5 is provided on that side of shadow mask 21 which is not supported by centering members 4. The force with which this spring-loaded support 5 acts from below on shadow mask 21 is preferably chosen so that shadow mask 21 rests at all three points of support with about the same force.

Instead of pins, other members having a shape suitable for centering leaf springs 22, such as leafshaped levers, may, of course, be used for centering members 4.

After shadow mask 21 has been positioned as described above, the members 6 projecting upwardly from mask table 2 are forced upward against the under surface of shadow mask frame 24, the force of members 6 being so small that shadow mask 21 will not be moved out of position. The areas of contact of members 6 with shadow mask 21 are slightly inclined to the vertical so as to be capable of also receiving forces acting from above. The gripping members 8 are moved toward mask frame 24 from outside, acting on the areas between the fixing points (notches 20) and holes 23 of leaf springs 22 and thus forcing leaf springs 22 against shadow mask 21. Centering members 4 are removed from the region of shadow mask 21 and faceplate 31 by pneumatic means 7, for example. When centering members 4 have been removed, shadow mask 21 is supported by locked members 6 and 8. Shadow mask 21, so held in place via leaf springs 22, is lowered vertically with mask table 2 to the point where it does not get in the way during the positioning of, and cannot come into contact with faceplate 31.

Manually or by means of a conveyor (not shown), faceplate 31 fitting shadow mask 21 in the device is placed on faceplate table 1 with the curved side up in about the middle of shadow mask 21. To insure that faceplate 31 is seated in a sufficiently accurate position, guide members 9—here upright pins with an upper tapered portion—are provided on faceplate table 1. Faceplate 31 slides along these guide members 9 into a sufficiently accurate position, in which it rests on the faceplate spring-loaded supports 10.

Faceplate 31 is then lifted by an upward movement of the forks 11. Forks 11 are disposed on those three sides of faceplate 31 where centering members 4 are provided for the corresponding sides of shadow mask 21. They are notched at their upper edges, and are so arranged between tables 1 and 2 that three of studs 30 of the positioned faceplate 31 engage the notches of forks 11 when the latter are moved upward. To prevent faceplate 31 from tilting as already explained in more detail by reference to shadow mask 21, a spring-loaded support 12 is also provided for faceplate 31. What was said about the force of spring-loaded support 5 for the shadow mask 21 applies equally to spring-loaded support 12. After forks 11 have reached their highest position, the corresponding faceplate studs 30 are in a defined position relative to the device.

Faceplate supports 10 follow the upward movement of faceplate 31 because of their spring loading and can be locked in any position. Thus, when forks 11 are subsequently lowered again, supports 10 carry faceplate 31 in the position found by their upward movement.

Now that the three faceplate studs 30 and the holes of the three associated leaf springs 22 have a fixed relationship to the device, studs 30 and leaf springs 22 can be placed opposite each other by lifting mask table 2 again so that after gripping members 8 have been unlocked, studs 30 can enter holes 23 of leaf springs 22.

The faceplate/shadow mask combination so assembled can now be removed from the device either manually or by means of a conveyor (not shown).

Figure 4:
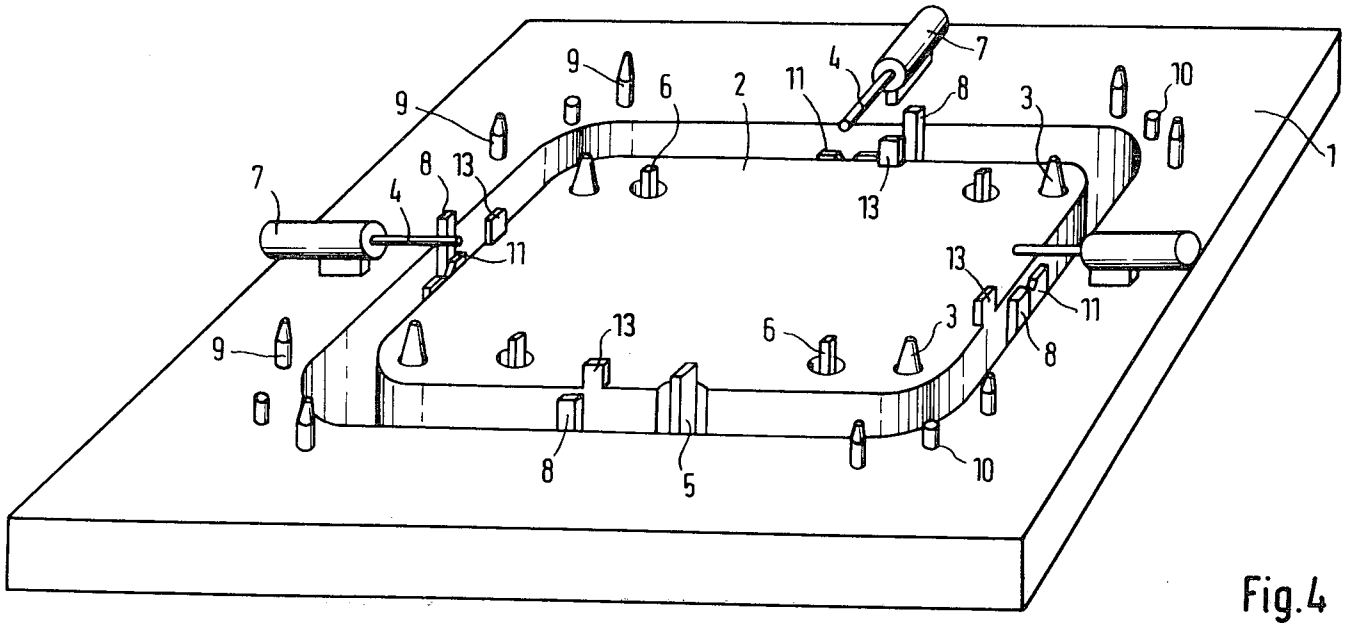
FIG. 4 shows another embodiment of the device in accordance with the principles of the present invention.

FIG. 4 shows a slightly modified embodiment of the device. Abutments 13 are provided on mask table 2 at its sides and opposite gripping members 8. When shadow mask 21 rests on mask table 2, these abutments 13 extend between leaf springs 22 of the mask and mask frame 24 in such a way that when gripping members 8 are moved against mask frame 24, leaf springs 22 will be forced against abutments 13. This has the advantage that leaf springs 22 can be held very firmly between gripping levers 8 and abutments 13 without these forces acting between leaf spring 22 and mask frame 24.

In addition, the embodiment of FIG. 4 has no separate spring-loaded support for that side of faceplate 31 which is not supported by a fork 11 during positioning. The two faceplate supports 10 adjacent to this side of faceplate 31 press against faceplate 31 with a force greater than that exerted by the opposite supports, thus preventing any unstable position or tilting of faceplate 31 during positioning with forks 11.

How the two tables 1 and 2 of the device are steadied by means of a frame, and how the individual moving parts are operated, e.g. pneumatically, by means of control equipment, has not been described and is not shown, because possibilities of doing this are known to those skilled in the art.

While we have described above the principles of our invention in connection with specific apparatus it is to be clearly understood that this description is made only by way of example and not as a limitation to the scope of our invention as set forth in the objects thereof and in the accompanying claims.

We claim:

1. A device for inserting a substantially rectangular shadow mask into a substantially rectangular faceplate of a color picture tube comprising:

a first horizontal table having an upper horizontal surface, a lower horizontal surface and a central cut out therein, said faceplate having N studs each secured to and extending inwardly from the inner surface of a different side of said faceplate, said N studs being employed as reference points for said device, where N is an integer greater than two;

a second horizontal table having an upper horizontal surface and a lower horizontal surface disposed in said cut out, said shadow mask having a frame and N leaf springs on the external surface of said frame, each of said N leaf springs being positioned on said frame to be associated with one of said N studs and having a hole for receiving said associated one of said N studs and a first positioning notch to enable said device to employ said N leaf springs as reference members;

one of said first and second tables being fixed and the other of said first and second tables being vertically movable such that when said shadow mask is positioned on said second table said upper surfaces of said first and second tables are in the same plane and when said faceplate is positioned on said first table, after positioning said shadow mask on said second table, said second table is lower than said first table;

four first guide members projecting upwardly from said upper surface of said second table, each of said first guide members being shaped like truncated cones to engage the inside of said frame when said shadow mask is placed on said second table to preposition said shadow mask on said second table; and at least three centering members each fastened to said upper surface of said first table in association with a different one of said N leaf springs, each of said centering members being movable by a means in a plane parallel to said upper surface of said first and second tables for fine positioning of said shadow mask on said second table, said means moving each of said centering members against the outer circumference of said frame to engage an associated one of said first notches and moving each of said centering members outside said shadow mask and said faceplate region when said centering members are in their rest position.

2. A device according to claim 1, wherein said first table is fixed and said second table can assume two vertical positions, an upper position in which said shadow mask is positioned on said second table and after positioning said faceplate on said first table each of said holes are brought to a position in which they are ready to receive said associated one of said studs and a lower position in which said shadow mask is held in a fixed relationship to said first and second tables and said faceplate is positioned on said first table.

3. A device according to claim 2, wherein

N is equal to four and said centering members are movable against three sides of said frame, and further including a vertically movable spring-loaded support disposed in association with said second table to resiliently support the fourth side of said frame to prevent tilting of said shadow mask whose center of gravity is disposed to cause tilting of said shadow mask about two opposite ones of said centering members.

4. A device according to claim 2, wherein said second table further includes at least three vertically movable shadow mask support members projecting upward from said upper surface of said second table movable against at least three points distributed around the periphery of said frame with a force not effecting the position of said shadow mask, said shadow mask support members being lockable in any position to support said shadow mask in said locked position after removal of said centering members.

5. A device according to claim 4, wherein said second table further includes N gripping members movable toward said frame and acting on an associated one of said N leaf springs to bend said associated one of said N leaf springs toward said frame.

6. A device according to claim 5, wherein said second table further includes N abutments extending upward from said upper surface of said second table between an associated one of said leaf springs and said frame, when said shadow mask is on said second table, such that when an associated one of said gripping members are moved toward said frame said associated one of said N leaf springs are forced against an associated one of said abutments.

7. A device according to claim 1 or 6, wherein said first table includes four second guide members projecting upwardly from said upper surface of said first table, each of said second guide members being shaped like truncated cones to preposition said faceplate on said first table.

8. A device according to claim 7, wherein said first table further includes three forks each having a second positioning notch acting on an associated one of said N studs so that said associated one of said N studs slide into said second notch when said faceplate is lifted by means of said three forks for fine positioning of said faceplate on said first table.

9. A device according to claim 8, wherein

N is equal to four, and said first table further includes a vertically movable spring-loaded support projecting from said upper surface of said first table to resiliently support that side of said faceplate which is not supported by said forks to prevent tilting of said faceplates whose center of gravity is disposed to cause tilting of said faceplate about two opposite ones of said forks.

10. A device according to claim 9, wherein said first table further includes at least three vertical movable faceplate support members projecting upward from said upper surface of said first table movable against at least three points distributed around the periphery of said faceplate with a force not effecting the position of said faceplate, said faceplate support members being lockable in any position to support said faceplate in said locked position after removal of said forks and said spring-loaded support of said first table.

11. A device according to claim 8, wherein said first table further includes at least three vertical movable faceplate support members projecting upward from said upper surface of said first table movable against at least three points distributed around the periphery of said faceplate with a force not effecting the position of said faceplate, said faceplate support members being lockable in any position to support said faceplate in said locked position after removal of said forks.

* * * * *